US007013101B2

(12) United States Patent
Maruyama et al.

(10) Patent No.: US 7,013,101 B2
(45) Date of Patent: Mar. 14, 2006

(54) CARTRIDGE RECYCLING INFORMATION APPARATUS, CORRESPONDING METHOD, AND CARTRIDGE TO BE RECYCLED

(75) Inventors: Akira Maruyama, Nagano-ken (JP); Osamu Ishibashi, Nagano-ken (JP); Kazuhiro Ichikawa, Nagano-ken (JP)

(73) Assignee: Seiko Epson Corporation, Tokyo (JP)

( * ) Notice: Subject to any disclaimer, the term of this patent is extended or adjusted under 35 U.S.C. 154(b) by 118 days.

(21) Appl. No.: 10/695,440

(22) Filed: Oct. 29, 2003

(65) Prior Publication Data

US 2005/0105934 A1 May 19, 2005

(30) Foreign Application Priority Data

Oct. 29, 2002 (JP) ..... 2002-313971
Jun. 2, 2003 (JP) ..... 2003-157243

(51) Int. Cl.
*G03G 15/00* (2006.01)

(52) U.S. Cl. ..... 399/109

(58) Field of Classification Search ..... 399/109, 399/110, 111, 8
See application file for complete search history.

(56) References Cited

U.S. PATENT DOCUMENTS 6,473,572 B1 * 10/2002 Uchiyama et al. ..... 399/24
6,512,896 B1 * 1/2003 Asanuma et al. ..... 399/25
6,625,402 B1 * 9/2003 Takemoto ..... 399/8
6,633,795 B1 * 10/2003 Suzuki et al. ..... 700/213
6,798,995 B1 * 9/2004 Nagata ..... 399/8
2001/0028800 A1 * 10/2001 Kim ..... 399/12
2004/0039587 A1 * 2/2004 Horoshige et al. ..... 705/1
2005/0078969 A1 * 4/2005 Kikuchi ..... 399/12

FOREIGN PATENT DOCUMENTS

JP 10198236 A * 7/1998
JP 2001117743 A * 4/2001

OTHER PUBLICATIONS

Return Box Request Sheet by Seiko Epson Corporation—retrieved on Sep. 13, 2002 Internet <url: http://www.i-love-epson.co.jp/products/toner/sheet.htm>, Complete.

* cited by examiner

*Primary Examiner*—Quana Grainger
(74) *Attorney, Agent, or Firm*—Sughrue Mion, PLLC

(57) ABSTRACT

A toner cartridge 40 has a storage element 50 that stores recycling information. A cartridge recycling information apparatus of the invention outputs a recycling request form based on the recycling information stored in the storage element 50 at a specified output timing of the recycling information. This arrangement desirably saves the user's labor and time of searching for the recycling request form and enables the user to be readily notified of the recycling information.

22 Claims, 14 Drawing Sheets

FIG.5

| | | |
|---|---|---|
| Toner ID | | 0A01 |
| Recycle Permission Factor | | EPSON |
| Recycling Information | Postal Address of Recycle Center | XX 01234-56, YY City, ZZ Prefecture |
| | Telephon Number | xx-yyyy-zzzz |
| | Facsimile Number | xx-yyyy-aaaa |
| | Refix Date | xxxx/xx/xx |
| Toner Information | Toner Color | K(Black) |
| | Initial Toner Quantity | AAA |
| | Setting of Output Unsuitable Range | KE |
| | Setting of Small Quantity Range | KXo |
| | Cumulative Consumption of Toner | KY |
| | Remaining Quantity of Toner | KX |
| | Output Form Flag | OFF(No Output) |
| | ..... | ..... |

FIG.8

(a) TONER CARTRIDGE WITH RECYCLE PERMISSION FACTOR

Recycling Request Form

We recycle toner cartridges. Please join our cartridge recycling program.

We will pick up your cartridges at an address you specify:

<Recycle Center >

Address: XX 01234-56, YY City, ZZ Prefecture

Telephone: xx-yyyy-zzz

Facsimile: xx-yyyy-aaaa (b) TONER CARTRIDGE WITHOUT RECYCLE PERMISSION FACTOR

Notification of Toner Cartridges

We can not accept your toner cartridges.

we recycle our genuine toner cartridges.

Please use our genuine toner cartridges.

FIG.11

| | |
|---|---|
| Environmental Information | Environment Label |
| | Recycle Parts |
| | Environmental Load |
| | ⋮ |

FIG.13

Recycling Request Form

We recycle toner cartridges. Please join our cartridge recycling program.

We will pick up your cartridges at an address you specify:

<Recycle Center>

Address: XX 01234-56, YY City, ZZ Prefecture

Telephone: xx-yyyy-zzzz

Facsimile: xx-yyyy-aaaa

U

---

Use of genuine toner cartridges are strongly recommended to ensure the good maintenance of products and the high-quality printing.

M

---

We recover and recycle used toner cartridges as one sphere of environmental activities. We ask you to join our toner cartridge recycling program for the environmental protection.

Environment Label

Your cooperation is essential for the toner cartridge recycling program.

<Recycle Parts>

- Main Body
- Storage Element

...

Non-recycled toner cartridges should be incinerated and buried in landfills.

Recycling of the used toner cartridges significantly reduces the emission of carbon dioxide and waste and desirably lowers the load on the environment.

.
.
.

L

CARTRIDGE RECYCLING INFORMATION APPARATUS, CORRESPONDING METHOD, AND CARTRIDGE TO BE RECYCLED

BACKGROUND OF THE INVENTION

1. Field of the Invention

The present invention relates to a cartridge recycling information apparatus and a corresponding method thereof, as well as a cartridge to be recycled.

2. Description of the Prior Art

In order to ask the manufacturer to collect used cartridges, the user is required to send a recycling request form with recycling information, which includes the number of cartridges and the postal address, the telephone number, and the facsimile number of a cartridge recycle center, to the manufacturer. In many cases, a copy of the recycling request form is supplied with a commercially available cartridge in a package.

At the time of replacement of a used cartridge, the user should search for a copy of the recycling request form, which has been supplied in the package, to obtain the recycling information. Namely the user can not readily receive the recycling information. There are some Web sites to provide recycling request forms for cartridges on the Internet (for example, see online service 'Return Box Request Sheet' by SEIKO EPSON CORPORATION '[retrieved on Sep. 13, 2002], Internet <URL: http://www.i-love-epson.co.jp/products/toner/sheet.htm>). This method, however, requires the user to access the corresponding Web site and thus does not ensure the user's easy acquisition of the recycling request form.

SUMMARY OF THE INVENTION

The object of the present invention is thus to eliminate the drawbacks of the prior art technique and to provide a cartridge recycling information apparatus and a corresponding method that save the user's time and labor of searching for a recycling request form and enable the user to be readily notified of recycling information. The object of the invention is also to provide a cartridge suitable for such a cartridge recycling information apparatus. The object of the invention is further to provide a program that causes a computer to function as such a cartridge recycling information apparatus.

In order to achieve at least a part of the aforementioned objects, a cartridge recycling information apparatus of the invention is constructed as an apparatus that gives cartridge recycling information, and the cartridge recycling information apparatus include: a cartridge having a storage element that stores recycling information of the cartridge; an output timing specification module that specifies an output timing of the recycling information; and a recycling information output module that outputs the recycling information stored in the storage element at the output timing of the recycling information specified by the output timing specification module.

The cartridge recycling information apparatus of the invention outputs the recycling information of the cartridge stored in the storage element of the cartridge at the specified output timing of the recycling information. This arrangement desirably saves the user's labor and time of searching for a recycling request form and enables the user to be readily notified of the recycling information. It is desirable that latest pieces of the recycling information are stored in the storage element. This enables the user to be notified of the latest recycling information.

In the cartridge recycling information apparatus of the invention, the recycling information output module may utilize the cartridge to print out the recycling information stored in the storage element.

The cartridge recycling information apparatus may include multiple cartridges corresponding to multiple different colors and the recycling information output module may utilize a cartridge having a specific remaining quantity of a coloring matter, which enables the recycling information to be printed, among the multiple cartridges, to print out the recycling information.

In the cartridge recycling information apparatus of the invention, the storage element may store environmental information regarding an environmental activity, and the recycling information output module may output the environmental information in addition to the recycling information.

In the cartridge recycling information apparatus of the invention, the output timing specification module may acquire information on a remaining quantity of a coloring matter kept in the cartridge and specify a timing when the remaining quantity enters a preset small quantity range as the output timing of the recycling information. Here, the preset small quantity range may be specified to have a specific remaining quantity that is greater than zero and at least allow the recycling information output module to print the recycling information.

In the cartridge recycling information apparatus of the invention, the output timing specification module may specify a timing when an input representing a start of replacement of the cartridge is received as the output timing of the recycling information.

In the cartridge recycling information apparatus of the invention, the output timing specification module may specify a timing when an input representing completion of replacement of the cartridge is received as the output timing of the recycling information, and the recycling information output module may output the recycling information stored in a storage element of a used cartridge prior to the replacement at the output timing of the recycling information specified by the output timing specification module.

In the cartridge recycling information apparatus of the invention, the output timing specification module may specify a timing when an input representing completion of replacement of the cartridge is received as the output timing of the recycling information, and the recycling information output module may compare the recycling information stored in a storage element of a used cartridge prior to the replacement with the recycling information stored in a storage element of a replacement cartridge and output a newer version of the recycling information at the output timing of the recycling information specified by the output timing specification module.

In the cartridge recycling information apparatus of the invention, the storage element may store a recycle permission factor representing that the cartridge with the storage element is recyclable, and the cartridge recycling information apparatus may further include: a recyclability judgment module that determines whether the recycle permission factor is stored in the storage element; and a recycling rejection output module that outputs a message showing that the cartridge with the storage element is unacceptable, when the recyclability judgment module determines that the recycle permission factor is not stored in the storage element.

A cartridge of the invention is a cartridge having a storage element that stores recycling information of the cartridge.

This cartridge is suitably used as a constituent of the cartridge recycling information apparatus of the invention. In the cartridge of the invention, the storage element may store a recycle permission factor representing that the cartridge with the storage element is recyclable.

A cartridge recycling information method of the invention may utilize a cartridge having a storage element that stores recycling information of the cartridge and causes a computer to output recycling information, and the cartridge recycling information method including the steps of: (a) causing the computer to specify an output timing of the recycling information; and (b) causing the computer to output the recycling information stored in the storage element at the output timing of the recycling information specified in the step (a).

The cartridge recycling information apparatus of the invention outputs the recycling information of the cartridge stored in the storage element of the cartridge at the specified output timing of the recycling information. This arrangement desirably saves the user's labor and time of searching for a recycling request form and enables the user to be readily notified of the recycling information. It is desirable that latest pieces of the recycling information are stored in the storage element. This enables the user to be notified of the latest recycling information. The cartridge recycling information method of the invention may have additional steps for attaining any of the additional functions of the cartridge recycling information apparatus discussed above, or may alternatively have a supplementary structure to attain any of the additional functions. The respective steps of the cartridge recycling information method may be written in the form of a program, which is executed by a computer. The program may be recorded in a computer readable recording medium (for example, a hard disk, a ROM, an FD, a CD, or a DVD), may be delivered from one computer to another computer via a transfer medium (a communication network like the Internet or a LAN), or may be provided in any other suitable form. All the steps included in the program may be executed by one single computer. Otherwise multiple computers may share execution of the respective steps of the program.

BRIEF DESCRIPTION OF THE DRAWINGS

FIG. 5 shows one example of information stored in the storage element;

FIG. 8 shows one example of the recycling request form and a printout showing that the toner cartridge is unacceptable;

FIG. 11 shows one example of environmental information;

FIG. 13 shows one example of the recycling request form including environmental information.

DESCRIPTION OF THE PREFERRED EMBODIMENTS

Figure 1:
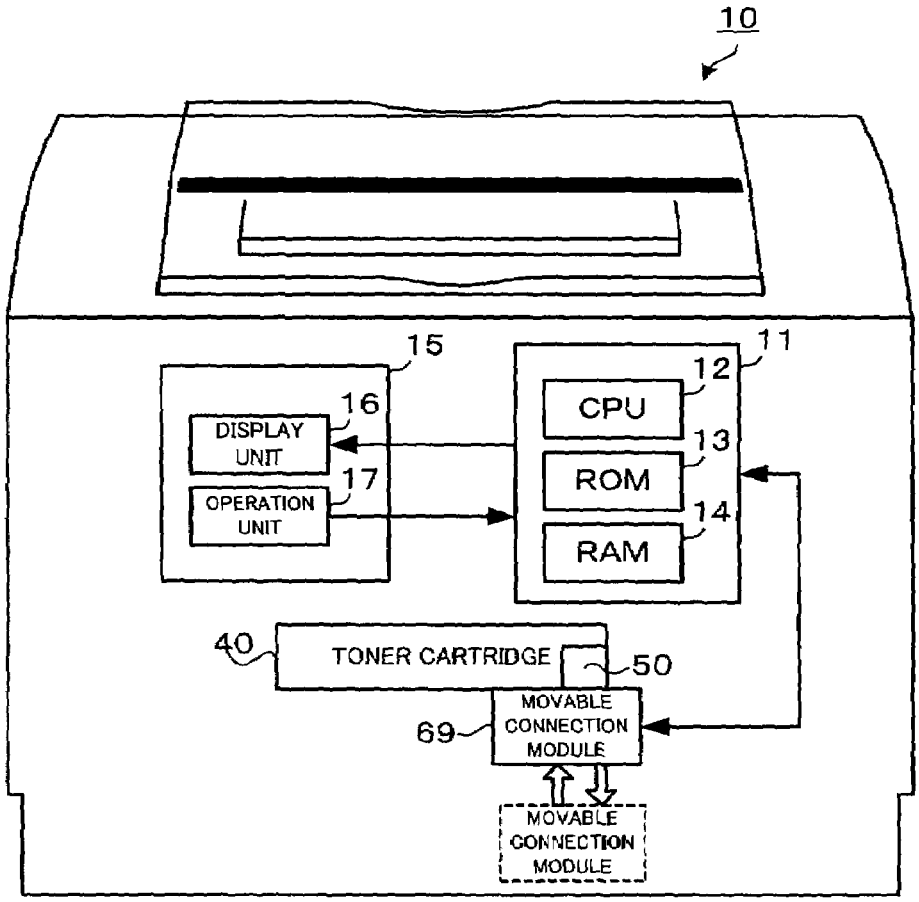
FIG. 1 is a block diagram schematically illustrating the construction of a color laser printer in one embodiment of the invention.
Figure 2:
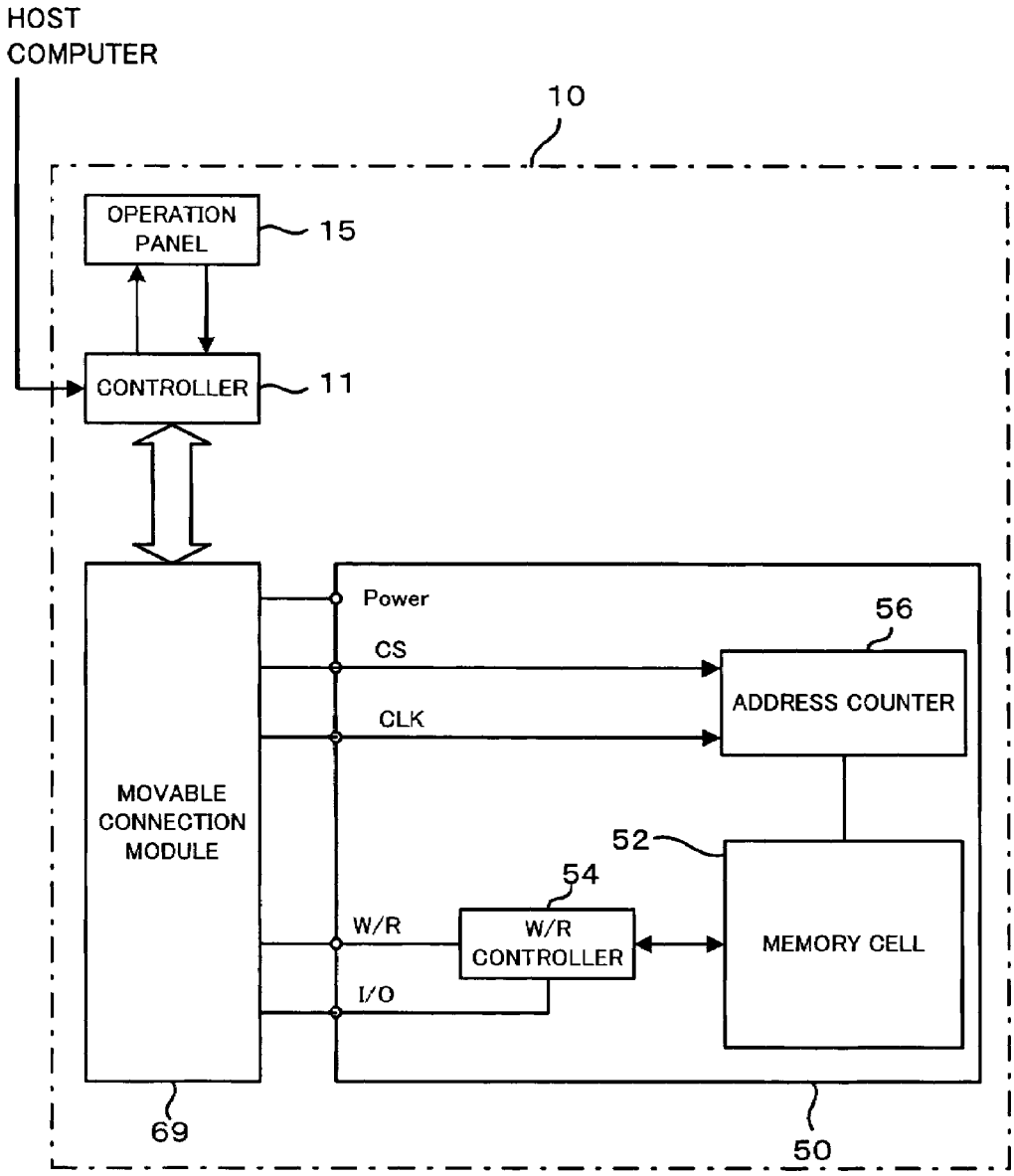
FIG. 2 is a block diagram showing electrical connection of functional blocks including a storage element of a toner cartridge attached to the color laser printer of FIG. 1.

Some embodiments of the invention are discussed below with reference to the accompanied drawings. FIG. 1 is a block diagram schematically illustrating the construction of a color laser printer 10 in one embodiment of the invention. FIG. 2 is a block diagram showing electrical connection of functional blocks including a storage element 50 of a toner cartridge 40 attached to the color laser printer 10. The color laser printer 10 functions as a printer that is capable of color printing and as the cartridge recycling information apparatus of the invention. The structure of the color laser printer 10 relating to color printing will be discussed later with reference to FIG. 4. The structure of the color laser printer 10 relating to the functions of the cartridge recycling information apparatus is discussed first with reference to FIGS. 1 and 2.

The color laser printer 10 mainly includes a controller 11, an operation panel 15, a movable connection module 69, and a toner cartridge 40. The controller 11 is constructed as a known computer having a CPU 12, a ROM 13, and a RAM 14. The operation panel 15 has a display unit 16 that is used to show various pieces of information on a display and an operation unit 17 that has keys or touch panels to be manipulated for entry of various pieces of information into the controller 11. The movable connection module 69 is movable between a position to establish an electrical connection with a storage element 50 integrated with the toner cartridge 40 and a position to establish no electrical connection with the storage element 50. When the movable connection module 69 is located at the position to establish the electrical connection with the storage element 50, the controller 11 can gain access to the storage element 50 via the movable connection module 69. The toner cartridge 40 integrated with the storage element 50 keeps therein a toner of one color among four colors C (cyan), M (magenta), Y (yellow), and K (black) and is detachably attached to inside of the color laser printer 10. As discussed later, there are actually four toner cartridges 40 corresponding to these four colors C, M, Y, and K, that is, toner cartridges 40C, 40M, 40Y, and 40K. These four toner cartridge 40C, 40M, 40Y, and 40K are detachably attached to the inside of the color laser printer 10. For convenience of explanation, these toner cartridges 40C, 40M, 40Y, and 40K are collectively referred to as the toner cartridge 40.

Figure 3:
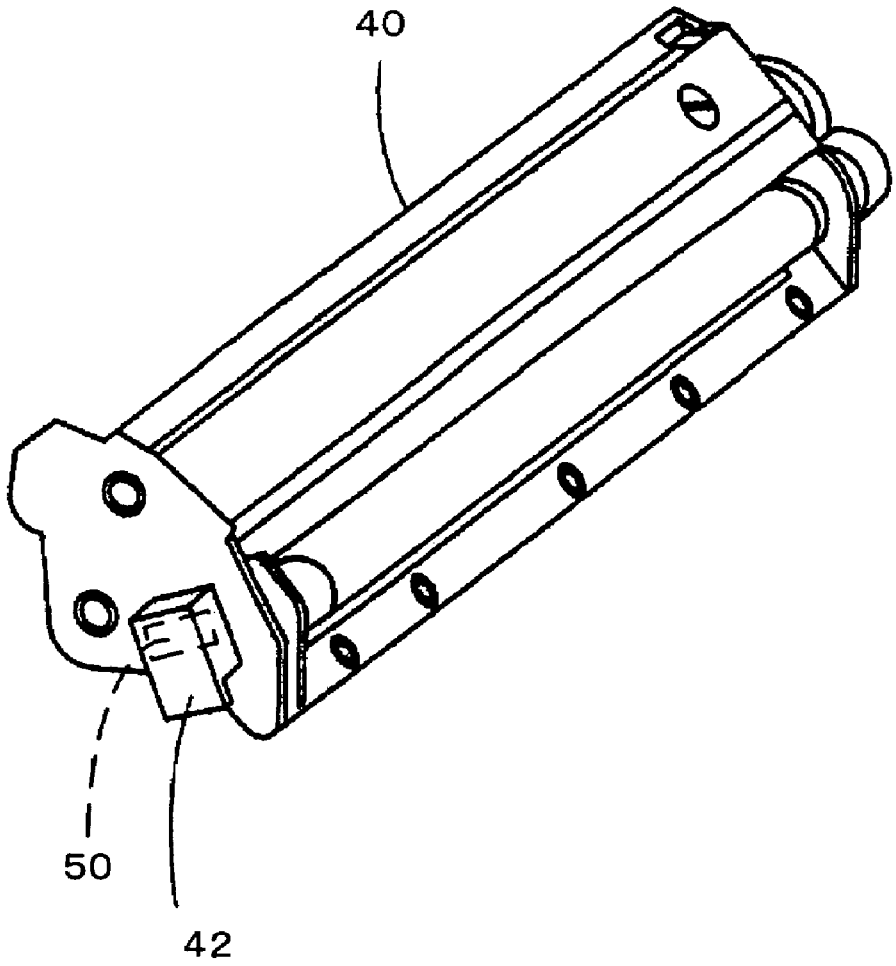
FIG. 3 shows the appearance of the toner cartridge.

As shown in FIG. 2, the storage element 50 has a memory cell 52 that stores data therein, a read-write controller 54 that controls operations of reading and writing data from and into the memory cell 52, and an address counter 56 that counts up the address in response to a clock signal CLK in the course of data transmission to and from the controller 11 via the read-write controller 54. An EEPROM is a typical example of the storage element 50. FIG. 3 shows the appearance of the toner cartridge 40. As illustrated, the toner cartridge 40 of the embodiment has the storage element 50 set inside a holder 42, which is attached to one end of the toner cartridge 40.

Figure 4:
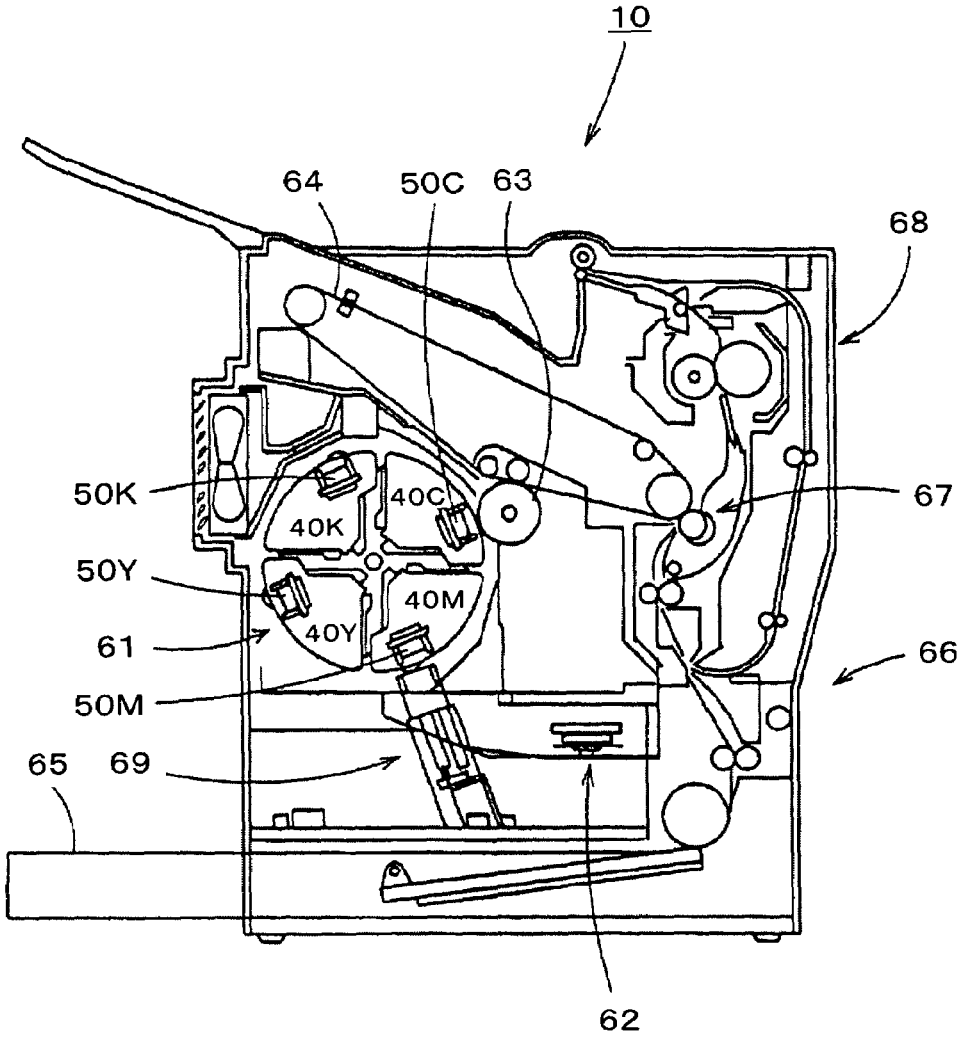
FIG. 4 schematically illustrates the structure of the color laser printer of FIG. 1 relating to color printing.

FIG. 4 schematically illustrates the color printing-related structure of the color laser printer 10 with the toner cartridge 40 attached thereto. The color laser printer 10 with the toner cartridge 40 attached thereto is constructed as a full-color electrophotographic image formation device that adopts a single photoreceptor system and an intermediate transfer system. An original color image is subjected to color separation into four color image components of cyan (C), magenta (M), yellow (Y), and black (K). As shown in FIG. 4, the system creates electrostatic latent images of the respective color image components on a photoreceptor 63 by means of an exposure unit 62, forms color toner images on the electrostatic latent images with color toners supplied from the toner cartridges 40C, 40M, 40Y, and 40K of the respective colors attached to a developer unit 61, and primarily transfers the color toner images in an overlapping manner onto a transfer belt 64 as working an intermediate transfer member. A secondary transfer unit 67 then functions to transfer the four color toner images, which have been transferred to the transfer belt 64 in the overlapping manner, onto a sheet of printing paper that is supplied from a paper cassette 65 and is fed by means of a feeder unit 66. A resulting color image is completed on the printing paper by fusing and fixing the transferred toner images on the printing paper by means of a fixation unit 68. The developer unit 61 is rotatable to form the respective color toner images on the photoreceptor 63. The color laser printer 10 is also provided with the movable connection module 69 that connects with each of storage elements 50C, 50M, 50Y, and 50K of the respective toner cartridges 40C, 40M, 40Y, and 40K attached to the developer unit 61, when the corresponding storage element 50 is located at a lower right position in the drawing. The movable connection module 69 functions to read and write various pieces of information from and into the storage element 50. The exposure unit 62 has a known structure that exposes the photoreceptor 63 to a laser beam, which is scanned with a polygon mirror driven and rotated by a motor, to form the electrostatic latent images.

FIG. 5 shows one example of the information stored in the storage element 50 of the toner cartridge 40 (the black toner cartridge 40K). In the structure of this embodiment, a 'toner ID' representing an ID unequivocally allocated to the toner cartridge 40, a 'recycle permission factor' representing that the toner cartridge 40 with the storage element 50 is recyclable, 'recycling information', and 'toner information' are stored in the storage element 50. Here the 'recycling information' includes a 'postal address', a 'telephone number', and a 'facsimile number' of a 'recycle center' and a 'refix date' of the 'recycling information'. The 'toner information' includes a 'toner color' that identifies the color of toner filled in the toner cartridge 40, an 'initial toner quantity' that represents the quantity of new toner before use, a 'setting of output unsuitable range' that specifies a remaining quantity range of toner unsuitable for printout, a 'setting of small quantity range' that is specified to be a little greater than the 'setting of output unsuitable range' and to ensure printout of at least several sheets, a 'cumulative consumption of toner' that represents an accumulated consumption of toner for printing, a 'remaining quantity of toner' that is obtained by subtracting the 'cumulative consumption of toner' from the 'initial toner quantity', and an 'output form flag' that represents execution or non-execution of printout of a recycling request form. Among these pieces of information, the 'recycle permission factor', the 'recycling information', the 'toner color', the 'initial toner quantity', the 'setting of output unsuitable range', the 'setting of small quantity range', and the 'output form flag (default: OFF) are written into the storage element 50 at a factory where the toner cartridge 40 is manufactured. The 'cumulative consumption of toner' and the 'remaining quantity of toner' are written into the storage element 50 by the controller 11 at appropriate timings, while the toner cartridge 40 is attached to the color laser printer 10. The 'output form flag' is set 'OFF' (no output) when the printout of the recycling request form has not yet been executed, and is set 'ON' (output) after execution of the printout. At the time of manufacturing the toner cartridge 40, the default 'OFF' is set to the output form flag. The 'cumulative consumption of toner' is reset to zero by the controller 11 when the toner cartridge 40 is replaced.

Figure 6:
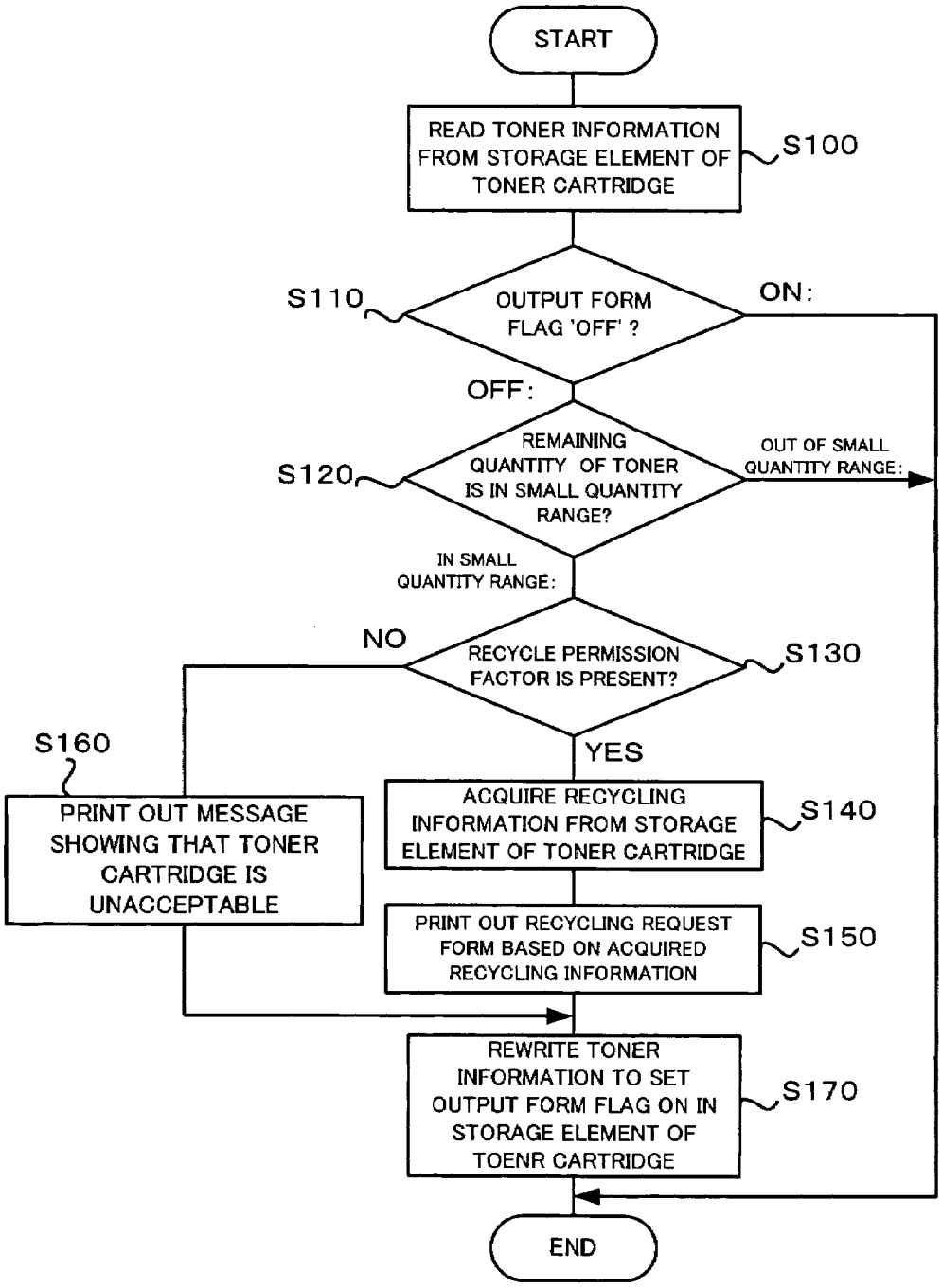
FIG. 6 is a flowchart showing a processing routine executed to print our a recycling request form (output in the small quantity range)

The color laser printer 10 having the above construction operates as discussed below. FIG. 6 is a flowchart showing a processing routine executed to print out a recycling request form when the 'remaining quantity of toner' is not greater than the 'setting of the small quantity range'. The program of this processing routine is stored in the ROM 13 of the controller 11 and is executed at preset intervals (for example, at every several msec) The following description regards a case of printing out a recycling request form with respect to the toner cartridge 40K. The controller 11 identifies the toner cartridge 40K by the toner ID (0A01) allocated thereto.

Figure 7:
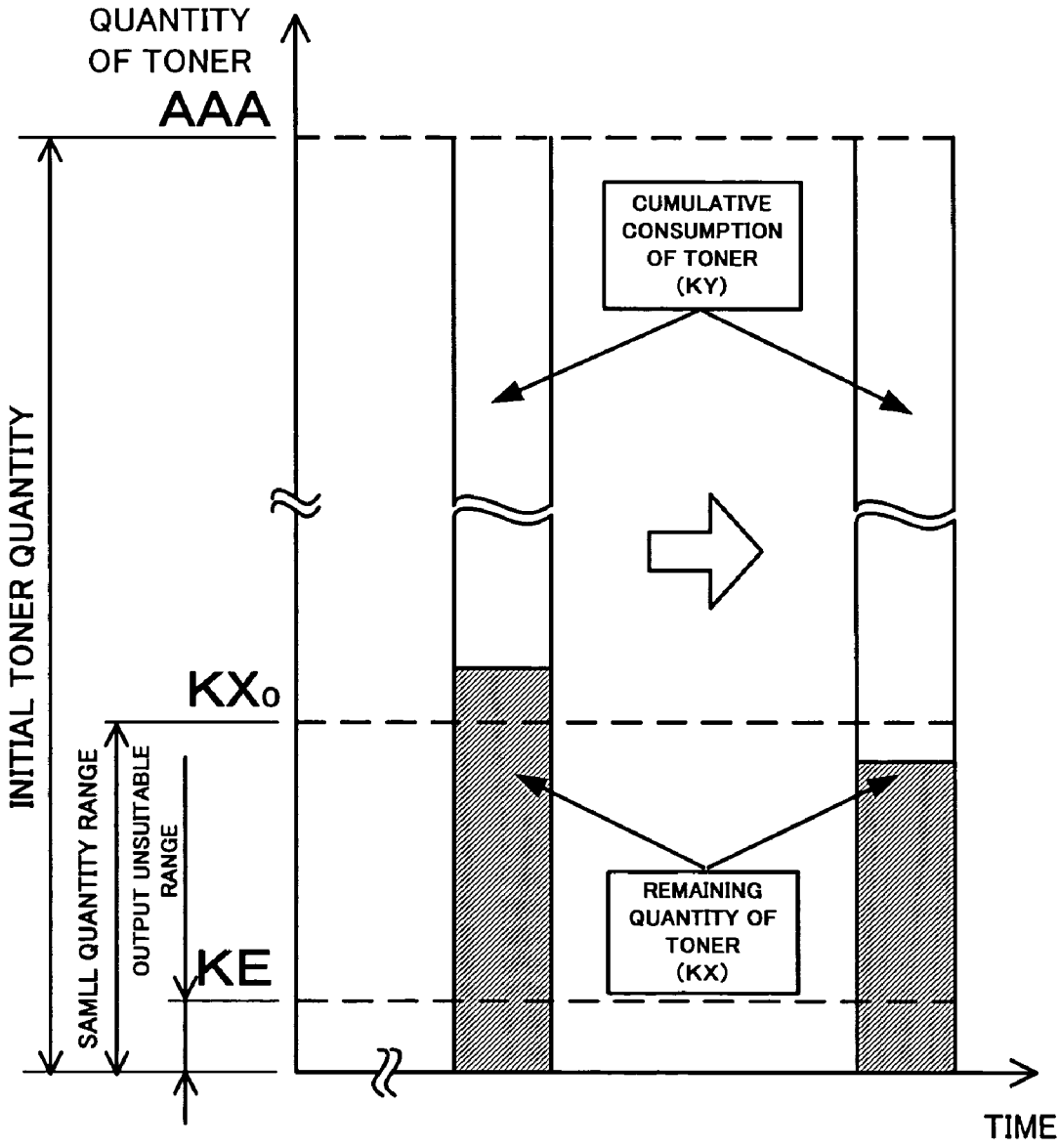
FIG. 7 shows a relation between the cumulative consumption of toner and the remaining quantity of toner.

As shown in the flowchart of FIG. 6, when the program of printing out a recycling request form starts, the controller 11 first reads the toner information stored in the storage element 50K of the toner cartridge 40K (step S100) and determines whether the 'output form flag' representing output of a recycling request form is set OFF (no output) (step S110). When it is determined at step S110 that the 'output form flag' is set OFF, the controller 11 compares the 'remaining quantity of toner' (KX) with the 'setting of small quantity range' (KX0) to determine whether the 'remaining quantity of toner' (KX) is in the small quantity range (step S120). FIG. 7 shows a decrease in 'remaining quantity of toner' (KX) with the use of the toner cartridge 40K. As shown in FIG. 7, the 'cumulative consumption of toner' (KY) increases with the use of the toner cartridge 40K and the 'remaining quantity of toner' (KX) approaches to the 'setting of small quantity range' (KX0). Referring back to the flowchart of FIG. 6, when it is determined at step S120 that the 'remaining quantity of toner' (KX) is not greater than the 'setting of small quantity range' (KX0) and is namely in the small quantity range, the controller 11 subsequently determines whether the 'recycle permission factor' is present in the storage element 50K (step S130). In the presence of the 'recycle permission factor' at step S130, the controller 11 acquires the recycling information from the storage element 50K (step S140) and prints out a recycling request form, based on the acquired recycling information with regard to the toner cartridge 40K (black) (step S150). In the absence of the 'recycle permission factor' at step S130, on the other hand, the controller 11 prints out a message showing that the toner cartridge 40K is unacceptable (step S160). After the processing of either step S150 or step S160, the controller 11 rewrites the toner information to set the 'output form flag' ON (output) in the storage element 50K of the toner cartridge 40K (step S170). The program then exits from the processing routine. When it is determined at step S110 that the 'output form flag' is set ON (output), the recycling request form has already been printed out. The program thus immediately exits from the processing routine. When it is determined at step S120 that the 'remaining quantity of toner' (KX) is greater than the 'setting of small quantity range' (KX0) and is namely out of the small quantity range, the program also immediately exits from the processing routine. FIGS. 8(*a*) and 8(*b*) show printouts in the presence of the 'recycle permission factor' and in the absence of the 'recycle permission factor'.

In the structure of the first embodiment discussed above, the toner cartridge 40 has the storage element 50 that stores the recycling information. The color laser printer 10 functioning as the cartridge recycling information apparatus of the invention outputs the recycling request form based on the recycling information at the specified output timing of the recycling information. This arrangement desirably saves the user's labor and time of searching for the recycling request form and enables the user to be readily notified of the recycling information.

In the structure of the embodiment, the recycling information is stored in the storage element 50 of the toner cartridge 40. It is accordingly not necessary to separately supply a printout of the recycling request form in the package of the toner cartridge 40. This prevents the possible loss of the recycling request form. In the case of transfer of the recycle center to another address, the only requirement is to update the recycling information.

The technique of the first embodiment specifies in the toner cartridge 40 the 'setting of small quantity range' that is a little greater than the 'setting of output unsuitable range', which represents the remaining quantity range of toner unsuitable for printout, and ensures printout of at least several sheets. When the 'remaining quantity of toner' reaches the 'setting of small quantity range', a recycling request form is printed out with the remaining toner.

The recycling request form is printed out before the 'remaining quantity of toner' in the toner cartridge 40 reaches zero. This gives the user a timely notice of requirement for replacement of the toner cartridge 40.

In the structure of the first embodiment, the 'recycle permission factor' representing that the toner cartridge 40 is recyclable is stored in the storage element 50 of the toner cartridge 40. When a toner cartridge has the 'recycle permission factor' in its storage element, the color laser printer 10 prints out the recycling request form to encourage the user to join the cartridge recycling program. When a toner cartridge does not have the 'recycle permission factor' in its storage element, on the other hand, the color laser printer 10 prints out a message showing that the toner cartridge is unacceptable.

The following describes a second embodiment of the invention. A color laser printer of the second embodiment has the identical hardware construction with that of the color laser printer 10 of the first embodiment discussed previously with reference to FIGS. 1 through 5. The constituents of the color laser printer of the second embodiment that are equal to those of the color laser printer 10 of the first embodiment are expressed by like numerals and are not specifically described here. The color laser printer of the second embodiment executes a series of processing discussed below.

Figure 9:
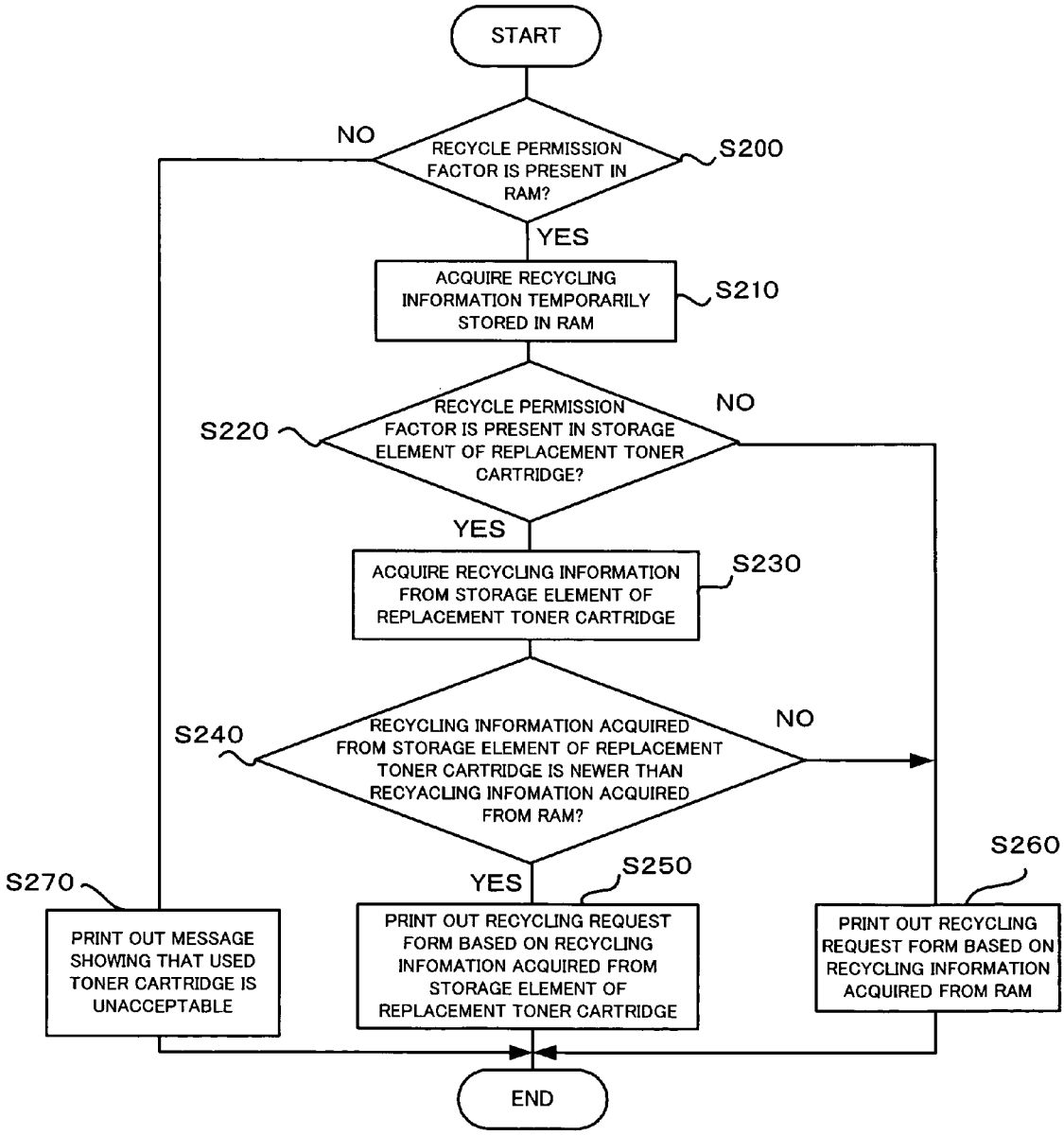
FIG. 9 is a flowchart showing another processing routine executed to print out the recycling request form (output after replacement)

FIG. 9 is a flowchart showing a processing routine executed to print out the recycling request form after replacement of the toner cartridge 40. The program of this processing routine is stored in the ROM 13 of the controller 11. Like the first embodiment, the following description regards a case of printing out a recycling request form with respect to the used toner cartridge 40K. The recycling information and the toner information stored in the storage element 50K of the used toner cartridge 40K are mapped to the toner ID (0A01) and are temporarily stored in the RAM 14. When the recycle permission factor is present in the storage element 50K of the used toner cartridge 40K, the recycle permission factor is also mapped to the toner ID (0A01) and is temporarily stored with the recycling information and the toner information in the RAM 14. Here the terminology 'after replacement' represents a time when the controller 11 compares the toner ID (0A01) of the used toner cartridge 40K temporarily stored in the RAM 14 with a toner ID (for example, 0C01) unequivocally allocated to a replacement toner cartridge and determines that these toner IDs are different from each other according to a flowchart (not shown).

As shown in the flowchart of FIG. 9, when the program of printing out a recycling request form starts after replacement of the toner cartridge 40K, the controller 11 first determines whether the 'recycle permission factor' is stored in the RAM 14 (step S200). When it is determined at step S200 that the 'recycle permission factor' is present in the RAM 14, the controller 11 acquires the recycling information from the temporary storage in the RAM 14 (hereafter referred to as the recycling information KR) (step S210) and subsequently determines whether the 'recycle permission factor' is present in the storage element 50K of a replacement toner cartridge 40K (step S220). When it is determined at step S220 that the 'recycle permission factor' is present in the storage element 50K of the replacement toner cartridge 40K, the controller 11 acquires the recycling information from the storage element 50K of the replacement toner cartridge 40K (hereafter referred to as the recycling information KN) (step S230). The controller 11 then compares the 'refix date' included in the recycling information KR with the 'refix date' included in the recycling information KN to specify a newer version of the recycling information (step S240). When the recycling information KN is newer than the recycling information KR, the controller 11 prints out a recycling request form based on the acquired recycling information KN (step S250). The program then exits from this processing routine. When it is determined at step S220 that the 'recycle permission factor' is not present in the storage element 50K of the replacement toner cartridge 40K or when it is determined at step S240 that the recycling information KR is newer than the recycling information KN, the controller 11 prints out a recycling request form based on the acquired recycling information KR (step S260). The program then exits from this processing routine. When it is determined at step S200 that the 'recycle permission factor' is not present in the RAM 14, on the other hand, the controller 11 prints out a message showing that the used toner cartridge 40K is unacceptable (step S270). The program then exits from this processing routine. Examples of the printouts in the presence of the 'recycle permission factor' and in the absence of the 'recycle permission factor' are shown in FIGS. 8(*a*) and 8(*b*).

As discussed above, in the structure of the second embodiment, the toner cartridge 40 has the storage element 50 that stores the recycling information. The technique of the second embodiment compares the recycling information stored in the used toner cartridge 40 with the recycling information stored in the replacement toner cartridge 40 and prints out the recycling request form based on the newer version of the recycling information. This arrangement enables the user to receive the latest recycling request form.

In the structure of the second embodiment, the recycling information is stored in the storage element 50 of the toner cartridge 40. It is accordingly not necessary to separately supply a printout of the recycling request form in the package of the toner cartridge 40. This prevents the possible loss of the recycling request form. In the case of transfer of the recycle center to another address, the only requirement is to update the recycling information. This arrangement desirably saves the user's time and labor of searching for the recycling request form and enables the user to be readily notified of the recycling information.

In the structure of the second embodiment, the 'recycle permission factor' representing that the toner cartridge 40 is recyclable is stored in the storage element 50 of the toner cartridge 40. When a toner cartridge has the 'recycle permission factor' in its storage element, the color laser printer prints out the recycling request form to encourage the user to join the cartridge recycling program. When a toner cartridge does not have the 'recycle permission factor' in its storage element, on the other hand, the color laser printer prints out a message showing that the toner cartridge is unacceptable.

The constituents of the first and the second embodiments are mapped to the elements of the present invention. The controller 11 of the embodiments corresponds to the output timing specification module and the recycling information output module. The above embodiments describe the color laser printer 10. The description gives examples of the cartridge recycling information method and the cartridge recycling information program of the invention, as well as the examples of the cartridge recycling information apparatus of the invention.

The above embodiments are to be considered in all aspects as illustrative and not restrictive. There may be many modifications, changes, and alterations without departing from the scope or spirit of the main characteristics of the present invention.

For example, the procedure of the first embodiment prints out the recycling request form when the 'remaining quantity of toner' (KX) reaches the 'setting of small quantity range' (KX0). One modified procedure may print out the recycling request form when the 'remaining quantity of toner' (KX) reaches the 'setting of output unsuitable range' (KE) shown in FIG. 7. The remaining quantity range of toner unsuitable for print output does not mean that the 'remaining quantity of toner' reaches zero. The recycling request form is thus printable with this remaining quantity of toner.

Figure 10:
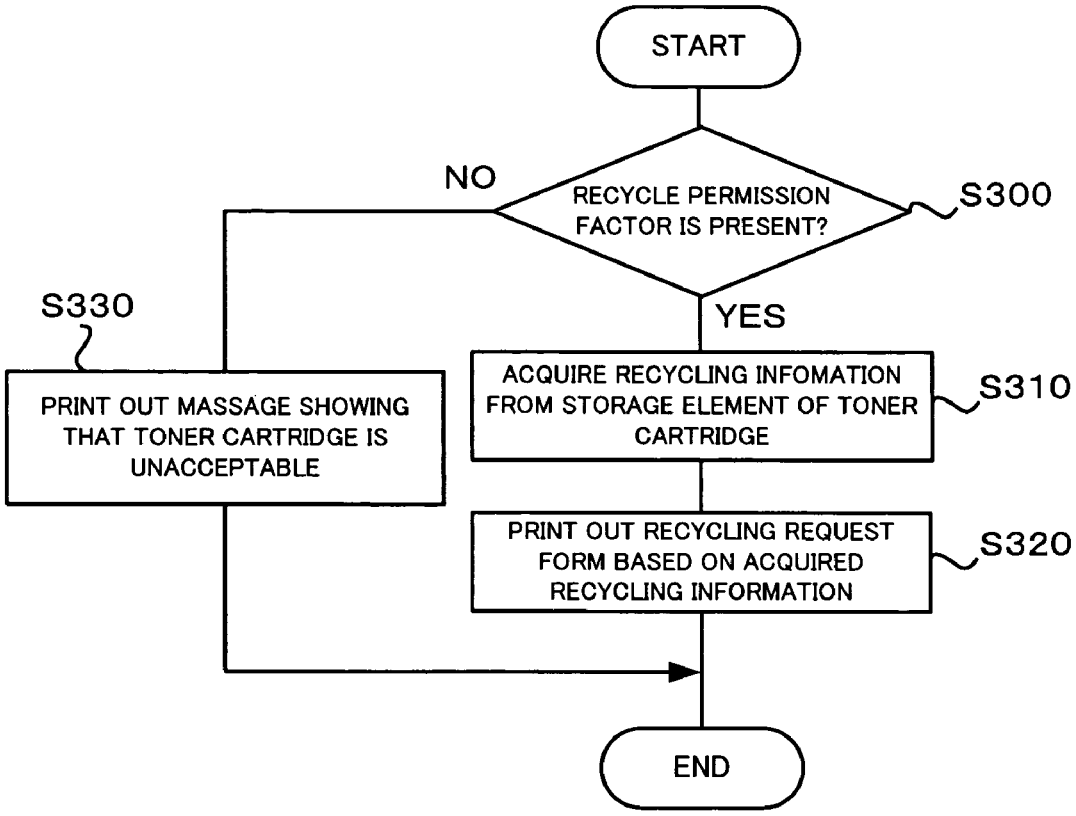
FIG. 10 is a flowchart showing still another processing routine executed to print out the recycling request form (output before replacement)

The procedure of the second embodiment prints out the recycling request form after replacement of the toner cartridge 40. One modified procedure may print out the recycling request form before replacement of the toner cartridge 40 in response to input of a toner cartridge replacement input unit (for example, a 'Replacement' button). FIG. 10 is a flowchart showing a processing routine executed to print out the recycling request form before replacement of the toner cartridge 40. As shown in the flowchart of FIG. 10, in response to input of the 'Replacement' button, the controller 11 determines whether the 'recycle permission factor' is present in the storage element 50K of the toner cartridge 40K (step S300). In the presence of the 'recycle permission factor' at step S300, the controller 11 acquires the recycling information from the storage element 50K of the toner cartridge 40K (step S310) and prints out the recycling request information based on the acquired recycling information (step S320). The program then exits from this processing routine. In the absence of the 'recycle permission factor' at step S300, on the other hand, the controller 11 prints out a message showing that the toner cartridge 40K is unacceptable (step S330). The program then exits from this processing routine. This arrangement prints out the recycling request form of the toner cartridge 40 before replacement of the toner cartridge 40 and thereby ensures smooth recycling request of the used toner cartridge 40.

The structure of the first embodiment or the second embodiment described above may have a 'Recycle Information' button for arbitrary acquisition of the recycling request form of the toner cartridge 40. The user can conveniently print out the recycling request form at any desirable time in response to activation of the 'Recycle Information' button. In this case, the time of activation of the 'Recycle Information' button represents the output timing of the recycling request form.

In the first and the second embodiments, the recycling request form is printed out with the toner cartridge 40K before replacement or after replacement of the toner cartridge 40K. One possible modification may obtain color information of a printing medium (for example, printing paper) by a sensor or another suitable means and select one or multiple color toners, which are conspicuous against the color of the printing medium, among the toner cartridges 40K, 40C, 40M, and 40Y to print out the recycling request form. For example, when the printing paper is white in color and the toner cartridge to be replaced is the toner cartridge 40Y (yellow in color), the recycling request form is printed out with a selected plain color or composite color like wine red, which is conspicuous against the white printing paper. This arrangement certainly informs the user of the replacement timing of the toner cartridge 40Y.

In the first and the second embodiments, the recycling request form is printed out, based on the recycling information stored in the toner cartridge 40 as the object of replacement. One possible modification may compare the respective 'refix dates' of the recycling information stored in the four toner cartridges 40C, 40M, 40Y, and 40K and print out the recycling request form based on the latest recycling information. This arrangement enables the user to give a recycling request based on the latest recycling information.

The procedure of the first or the second embodiment discussed above prints out the recycling request form, based on the recycling information. A modified procedure may also print out the 'toner color' of the toner information. This arrangement effectively informs the user of the color of the toner cartridge 40 to be replaced.

In the first and the second embodiments, the recycling request form is printed out with the toner cartridge 40. A cartridge containing a coloring matter other than toner (for example, ink) may replace the toner cartridge 40.

Figure 12:
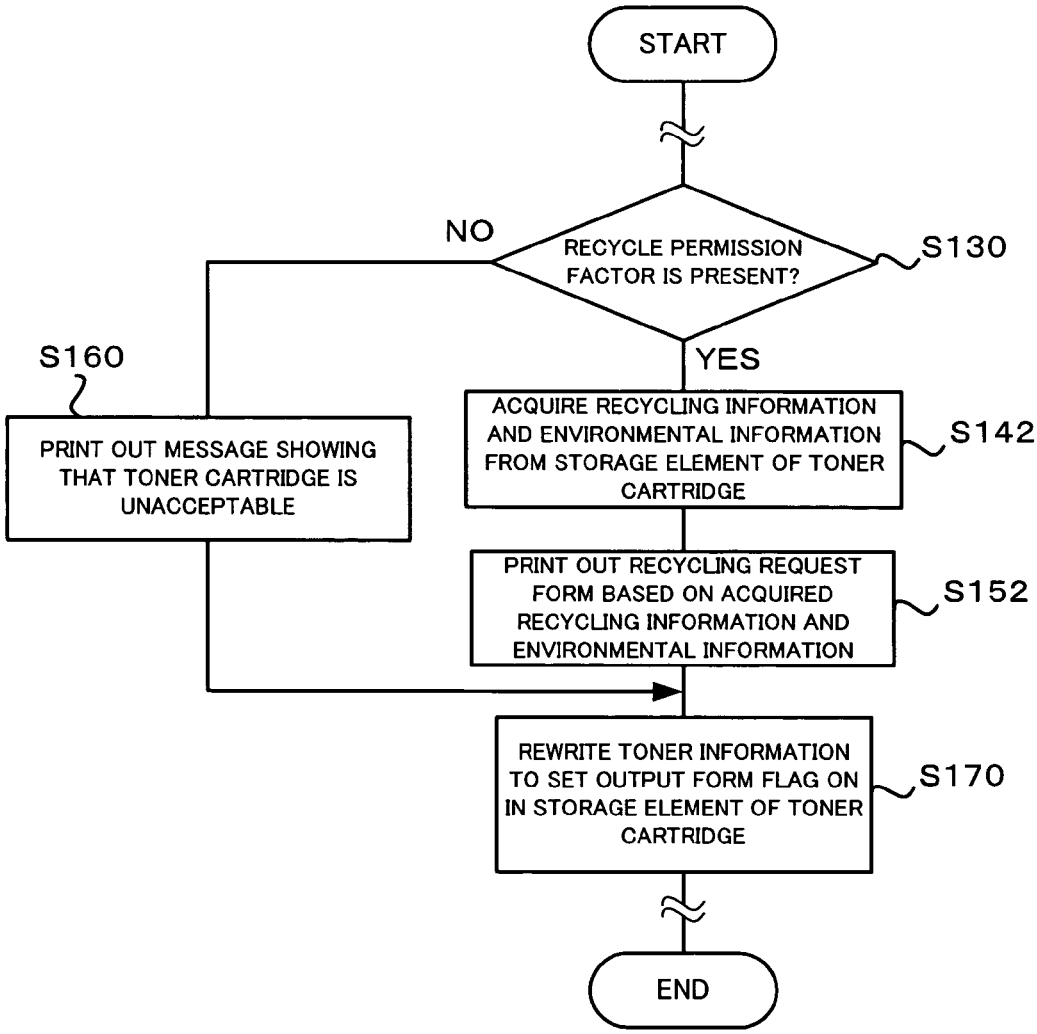
FIG. 12 is a flowchart showing another processing routine executed to print out the recycling request form (output in the small quantity range)

The procedure of the first embodiment prints out the recycling request form, based on the recycling information stored in the toner cartridge 40 as the object of replacement. One possible modification may print out the recycling request form, based on environmental information in addition to the recycling information. FIG. 11 shows one example of the environmental information stored in the storage element 50 of the toner cartridge 40. In the example of FIG. 11, the environmental information includes an 'environment label' that proves conformity to environmental control, 'recycle parts' representing recyclable parts, and an 'environmental load' showing a load on the environment in the case of non-recycle. FIG. 12 is a flowchart showing a processing routine executed to print out the environmental information in addition to the recycling request form. The flowchart of FIG. 12 modifies the processing of steps S140 and 150 among steps S100 through S170 in the flowchart of FIG. 6. The other steps in the flowchart of FIG. 12 are identical with the corresponding steps in the flowchart of FIG. 6 and are not specifically described here. When it is determined at step S130 that the 'recycle permission factor' is present in the storage element 50K of the toner cartridge 40K, the controller 11 acquires the recycling information and the environmental information from the storage element 50K (step S142) and prints out the recycling request form of the toner cartridge 40K, based on the recycling information and the environmental information acquired at step S142 (step S152). FIG. 13 shows one example of the printed recycling request form including the recycling information and the environmental information. As shown in FIG. 13, an upper section U includes the postal address, the telephone number, and the facsimile number of the recycle center as the recycling information. A middle section M includes a message that recommends the use of genuine toner cartridges. A lower section L includes the environment label, the recycle parts, and the environmental load as the environmental activities. The user reads the printed recycling request form to understand the environmental activities and to be encouraged to join the toner cartridge recycling program.

Figure 14:
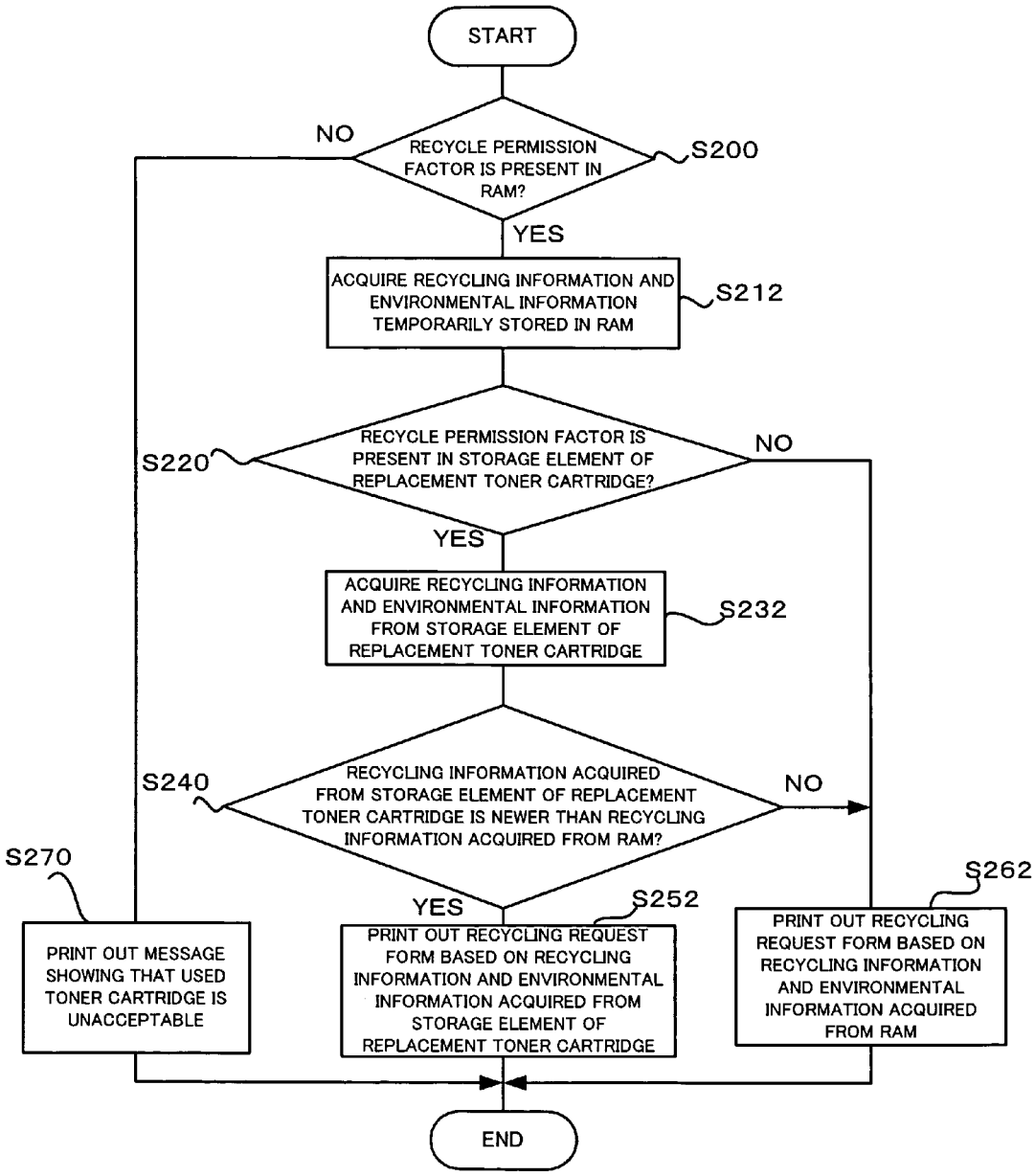
FIG. 14 is a flowchart showing still another processing routine executed to print out the recycling request form (output after replacement).

The procedure of the second embodiment prints out the recycling request form based on the recycling information after replacement of the toner cartridge 40. One modified procedure may print out the recycling request form, based on the environmental information in addition to the recycling information. FIG. 14 is a flowchart showing a processing routine executed to print out the recycling request form based on the environmental information as well as the recycling information after replacement of the toner cartridge 40. The flowchart of FIG. 14 has modified steps S210, S230, S250, and S260 among steps S200 through S270 in the flowchart of FIG. 9. The unmodified steps in the flowchart of FIG. 14 are identical with those in the flowchart of FIG. 9 and are not specifically described here. In this example, the environmental information as well as the recycling information is temporarily transferred to the RAM 14 from the storage element 50K of the toner cartridge 40K. When it is determined at step S200 that the 'recycle permission factor' is present in the RAM 14, the controller 11 acquires the recycling information KR and the environmental information from the temporary storage in the RAM 14 (step S212). When it is determined at subsequent step S220 that the 'recycle permission factor' is present in the storage element 50K of the replacement toner cartridge 40K, the controller 11 acquires the recycling information KN and the environmental information from the storage element 50K of the replacement toner cartridge 40K (step S232). When it is determined at subsequent step S240 that the recycling information KN read from the storage element 50K of the replacement toner cartridge 40K is newer than the recycling information KR read from the RAM 14, the controller 11 prints out the recycling request form based on the recycling information KN and the environmental information (step S252). When the recycling information KR read from the RAM 14 is newer than the recycling information KN read from the storage element 50K of the replacement toner cartridge 40K, on the other hand, the controller 11 prints out the recycling request form based on the recycling information KR and the environmental information (step S262). In this example, the recycling request form shown in FIG. 13 is printed out at either step S252 or step S262. The user reads the printed recycling request form to understand the environmental activities as well as the recycling information and to be encouraged to join the toner cartridge recycling program.

The procedure of the second embodiment prints out the recycling request form after replacement of the toner cartridge 40. Another modified procedure may print out the recycling request form including the environmental information before replacement of the toner cartridge 40 in response to input of a toner cartridge replacement input unit (for example, a 'Replacement' button). This modified procedure acquires the recycling information and the environmental information from the storage element 50K of the toner cartridge 40K at step S310 and prints out the recycling request form based on the acquired recycling information and environmental information at step S320 in the flowchart of FIG. 10. In this case, the recycling request form shown in FIG. 13 is printed out at step S320. This arrangement prints out the recycling request form of the toner cartridge 40 before replacement of the toner cartridge 40 and thereby ensures smooth recycling request of the used toner cartridge 40. This arrangement also informs the user of the environmental activities and encourages the user to join the toner cartridge recycling program.

In the specification hereof, the terminology 'recycle' or 'recycling' includes simple collection and return of spent cartridges, as well as recovery and reuse of part or all of the collected and returned cartridges. Similarly the terminology 'recyclable' means any of 'collectable', 'returnable', 'recoverable', and 'reusable'.

What is claimed is:

1. A cartridge recycling information apparatus that gives cartridge recycling information, said cartridge recycling information apparatus comprising:

a cartridge having a storage element that stores recycling information of the cartridge;

an output timing specification module that specifies an output timing of the recycling information; and a recycling information output module that outputs the recycling information stored in the storage element at the output timing of the recycling information specified by said output timing specification module.

2. A cartridge recycling information apparatus in accordance with claim 1, wherein said recycling information output module utilizes the cartridge to print out the recycling information stored in the storage element.

3. A cartridge recycling information apparatus in accordance with claim 1, said cartridge recycling information apparatus comprising multiple cartridges corresponding to multiple different colors, wherein said recycling information output module utilizes a cartridge having a specific remaining quantity of a coloring matter, which enables the recycling information to be printed, among the multiple cartridges, to print out the recycling information.

4. A cartridge recycling information apparatus in accordance with claim 1, wherein the storage element stores environmental information regarding an environmental activity, and said recycling information output module outputs the environmental information in addition to the recycling information.

5. A cartridge recycling information apparatus in accordance with claim 1, wherein said output timing specification module acquires information on a remaining quantity of a coloring matter kept in the cartridge and specifies a timing when the remaining quantity enters a preset small quantity range as the output timing of the recycling information.

6. A cartridge recycling information apparatus in accordance with claim 5, wherein the preset small quantity range is specified to have a specific remaining quantity that is greater than zero and at least allows said recycling information output module to print the recycling information.

7. A cartridge recycling information apparatus in accordance with claim 1, wherein said output timing specification module specifies a timing when an input representing a start of replacement of the cartridge is received as the output timing of the recycling information.

8. A cartridge recycling information apparatus in accordance with claim 1, wherein said output timing specification module specifies a timing when an input representing completion of replacement of the cartridge is received as the output timing of the recycling information, and said recycling information output module outputs the recycling information stored in a storage element of a used cartridge prior to the replacement at the output timing of the recycling information specified by said output timing specification module.

9. A cartridge recycling information apparatus in accordance with claim 1, wherein said output timing specification module specifies a timing when an input representing completion of replacement of the cartridge is received as the output timing of the recycling information, and said recycling information output module compares the recycling information stored in a storage element of a used cartridge prior to the replacement with the recycling information stored in a storage element of a replacement cartridge and outputs a newer version of the recycling information at the output timing of the recycling information specified by said output timing specification module.

10. A cartridge recycling information apparatus in accordance with claim 1, wherein the storage element stores a recycle permission factor representing that the cartridge with the storage element is recyclable, said cartridge recycling information apparatus further comprising:

a recyclability judgment module that determines whether the recycle permission factor is stored in the storage element; and a recycling rejection output module that outputs a message showing that the cartridge with the storage element is unacceptable, when said recyclability judgment module determines that the recycle permission factor is not stored in the storage element.

11. A cartridge having a storage element that stores recycling information of said cartridge.

12. A cartridge in accordance with claim 11, wherein said storage element stores a recycle permission factor representing that said cartridge with said storage element is recyclable.

13. A cartridge recycling information method that utilizes a cartridge having a storage element that stores recycling information of the cartridge and causes a computer to output recycling information, said cartridge recycling information method comprising the steps of:

(a) causing said computer to specify an output timing of the recycling information; and (b) causing said computer to output the recycling information stored in the storage element at the output timing of the recycling information specified in said step (a).

14. A cartridge recycling information method in accordance with claim 13, wherein said step (b) utilizes the cartridge to print out the recycling information stored in the storage element.

15. A cartridge recycling information method in accordance with claim 13, wherein said step (b) utilizes a cartridge having a specific remaining quantity of a coloring matter, which enables the recycling information to be printed, among multiple cartridges provided corresponding to multiple different colors, to print out the recycling information.

16. A cartridge recycling information method in accordance with claim 13, wherein the storage element stores environmental information regarding an environmental activity, and said step (b) outputs the environmental information in addition to the recycling information.

17. A cartridge recycling information method in accordance with claim 13, wherein said step (a) acquires information on a remaining quantity of a coloring matter kept in the cartridge and specifies a timing when the remaining quantity enters a preset small quantity range as the output timing of the recycling information.

18. A cartridge recycling information method in accordance with claim 17, wherein the preset small quantity range is specified to have a specific remaining quantity that is greater than zero and at least allows the recycling information to be printed in said step (b).

19. A cartridge recycling information method in accordance with claim 13, wherein said step (a) specifies a timing when an input representing a start of replacement of the cartridge is received as the output timing of the recycling information.

20. A cartridge recycling information method in accordance with claim 13, wherein said step (a) specifies a timing when an input representing completion of replacement of the cartridge is received as the output timing of the recycling information, and said step (b) outputs the recycling information stored in a storage element of a used cartridge prior to the replacement at the output timing of the recycling information specified by said step (a).

21. A cartridge recycling information method in accordance with claim 13, wherein said step (a) specifies a timing when an input representing completion of replacement of the cartridge is received as the output timing of the recycling information, and said step (b) compares the recycling information stored in a storage element of a used cartridge prior to the replacement with the recycling information stored in a storage element of a replacement cartridge and outputs a newer version of the recycling information at the output timing of the recycling information specified by said step (a).

22. A cartridge recycling information method in accordance with claim 13, wherein the storage element stores a recycle permission factor representing that the cartridge with the storage element is recyclable, in addition to said step (a) and (b), said cartridge recycling information apparatus further comprising the steps of (c) determining whether the recycle permission factor is stored in the storage element; and (d) outputting a message showing that the cartridge with the storage element is unacceptable, when said step (c) determines that the recycle permission factor is not stored in the storage element.

* * * * *